US006035459A

United States Patent [19]

Sadek

[11] Patent Number: 6,035,459

[45] Date of Patent: Mar. 14, 2000

[54] MOVABLE BATHTUB SEAT ASSEMBLY

[76] Inventor: Ahmed Sadek, 58 De Berats, Kirkland, Quebec, Canada, H9J 2N9

[21] Appl. No.: 09/241,736

[22] Filed: Feb. 2, 1999

[51] Int. Cl.[7] ..... A47K 3/12

[52] U.S. Cl. ..... 4/560.1

[58] Field of Search ..... 4/505, 559, 560.1, 4/571.1, 578.1, 579

[56] References Cited

U.S. PATENT DOCUMENTS

| | | | |
|---|---|---|---|
| 561,290 | 6/1896 | Stephenson | 4/579 |
| 2,648,849 | 8/1953 | Webb et al. | 4/560.1 |
| 2,852,785 | 9/1958 | Mikola | 4/579 |
| 3,935,599 | 2/1976 | Stark | 4/505 |
| 3,962,735 | 6/1976 | Davidson | 4/505 |
| 4,166,297 | 9/1979 | Saleeby | 4/578.1 |
| 4,292,696 | 10/1981 | Berger | 4/505 |
| 4,939,799 | 7/1990 | Van Hovel | 4/579 |
| 5,097,542 | 3/1992 | Roesler . | |
| 5,561,868 | 10/1996 | Campbell | 4/560.1 |
| 5,740,563 | 4/1998 | Gaddy . | |

*Primary Examiner*—Charles R. Eloshway

[57] ABSTRACT

A slidable bathtub seat assembly spanning the width of a bathtub and having rollers at both its end portions which securely and rollingly engage the top of bathtub side walls allowing the seated user to slide along the length of the bathtub. The user may immobilize the movable seat assembly at any desired position along the length of the bathtub by means of manually controlled pull rod actuators acting on side wall engaging brakes. The seat assembly further includes a frame formed of two telescopic sections adjustable to a variety of bathtub widths, a backrest, support handles and an outwardly spaced cane member having a bathroom floor engaging wheel.

15 Claims, 4 Drawing Sheets

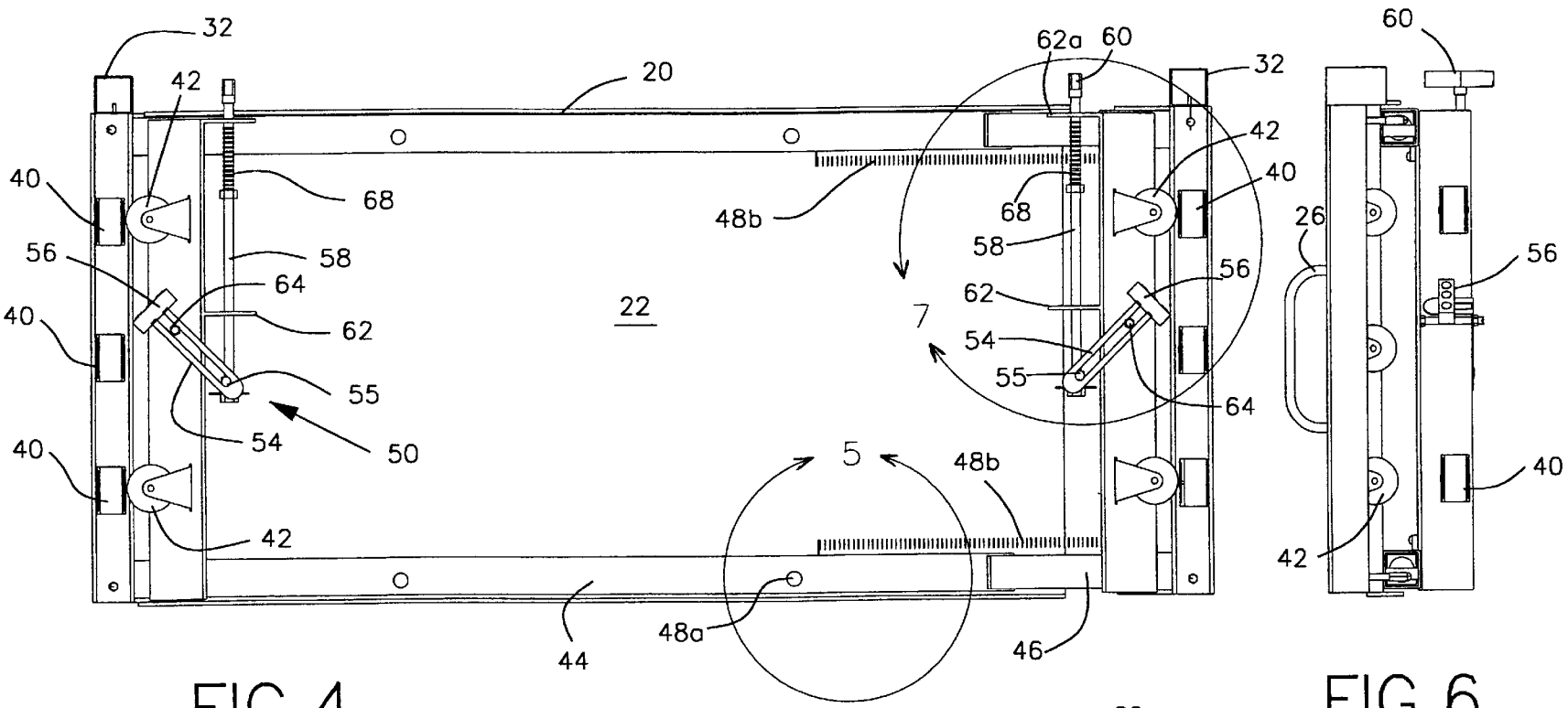
FIG. 6
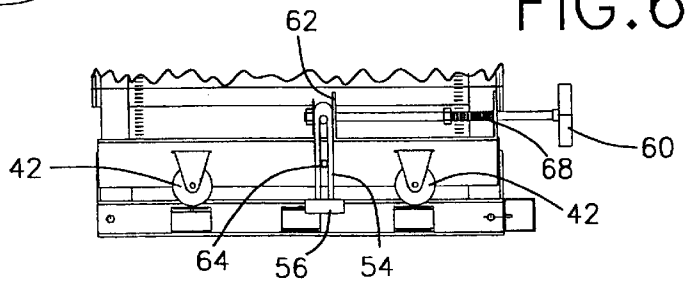
FIG. 7
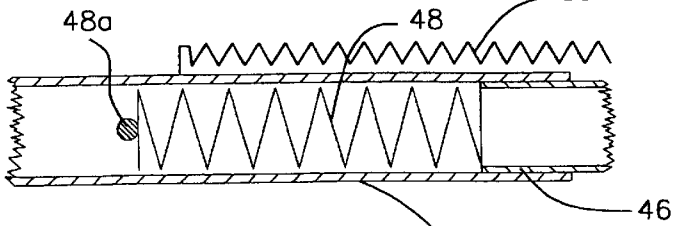
FIG. 5
FIG. 4

MOVABLE BATHTUB SEAT ASSEMBLY

FIELD OF THE INVENTION

The present invention relates to a bathtub seat and more particularly to a bathtub seat assembly movable along the length of a bathtub.

BACKGROUND OF THE INVENTION

Persons who suffer from partial temporary or permanent disabilities may experience difficulties in getting into and out of a bathtub and in bathing. Such persons may further injure themselves in the bathtub by slipping or falling. Bathtub chairs to solve the above problems have been invented and patented. U.S. Pat. No. 5,097,542 issued to Roesler on Mar. 24, 1992 disclosed a chair to fit inside a bathtub and supported on suction cup held legs. Later improvements included U.S. Pat. No. 5,740,563 issued to Gaddy on Apr. 21, 1998 disclosing a bathtub chair on a support means spanning the width of a bathtub and removably engaged on the top of the bathtub side walls.

The limitation of the prior art is that the user cannot move to any desired position along the length of the bathtub while seated because prior inventions do not provide a bathtub seat movable along the length of a bathtub. Since bathtubs come in a variety of lengths this again places an impaired user in danger of slipping or falling due to the fact that they would have to stand in order to move along the length of the bathtub when turning on the water or reaching for soap for example.

OBJECTS OF THE INVENTION

An object of the present invention to provide a movable bathtub seat assembly that obviates the above mentioned disadvantages.

Another object of the present invention is to provide a movable bathtub seat assembly for impaired users that has rollers which securely engage the top of bathtub side walls allowing the seated user to roll the seat assembly along the length of the bathtub.

A further object of the present invention is to provide a movable bathtub seat assembly with a brake system so that the seated user may easily immobilize the seat assembly at any desired position along the length of the bathtub.

Still another object of the present invention is to provide a movable bathtub seat assembly with a backrest, support handles and a cane support allowing the user to easily use the seat assembly and to easily and safely enter and exit the bathtub.

Still a further object of the present invention is to provide a movable bathtub seat assembly that is safe, accessible to a variety of users, easy to assemble on a bathtub and to transport when traveling and relatively inexpensive to manufacture.

Other objects and advantages of the present invention will become apparent from a careful reading of the detailed description provided herein, with appropriate reference to the accompanying drawings.

SUMMARY OF THE INVENTION

A bathtub seat assembly comprising a seat adapted to span a bathtub with its end portions over the top walls of the bathtub side walls, the seat also carrying at each end portion thereof a first set and a second set spaced rollers aligned transversely of said seat rollers with their rotation axes at substantially right angles to rollingly engage the top and the inside surface of the bathtub side walls respectively so that the seat may be moved by the seated user longitudinally of the bathtub, and a braking system mounted on the seat and operable by the seated user to stop the seat at any desired position along the length of the bathtub.

Preferably, the seat includes a seat frame formed of two telescoping frame sections to fit bathtubs of various widths with one frame section being longer than the other frame section and with the rollers mounted on the respective frame sections and a seat panel secured on top of the longer frame section. Preferably, the telescopic frame sections are spring biased to an extended state to bias said second set of rollers against the inside surfaces of said side walls. Preferably, the brake system is carried by the seat and includes a bathtub side wall engaging brake pad and a manual actuator connected to the brake pad.

Preferably, there are two braking systems respectively mounted on the two telescopic frame sections. Each braking system includes a bathtub side wall engaging brake pad movable between operative and inoperative positions and spring biased to inoperative position, and a pull rod manual actuator connected to the brake pad to move the brake pad to operative position. Preferably, the brake pad is automatically moved to an inoperative position when the seated user moves the seat in one direction.

Preferably, the bathtub seat assembly further includes guides carried by the longer telescopic section and guiding the pull rod actuator for longitudinal movement, a lever arm on one end of which the brake pad is secured and the other end of which is pivoted to the pull rod and a pivot carried by the longer telescopic frame section and on which the intermediate portion of the lever arm is pivotally and longitudinally movable.

Preferably, the bathtub seat assembly further includes a u-shaped cane member having a shorter leg secured to one end portion of the seat frame and upstanding from said seat, and a longer leg outwardly spaced from one end portion and adapted to be supported by the bathroom floor with a floor engaging wheel on the free end thereof. Preferably, a cane connector is secured to each end portion of the seat to releasably connect the shorter leg to either one of said end portions.

Preferably, the seat assembly further includes a backrest removably secured to the seat.

BRIEF DESCRIPTION OF THE DRAWINGS

In the annexed drawings, like reference characters indicate like elements throughout.

FIG. 4 is bottom view of the present invention;

FIG. 5 is a partial longitudinal section view of the telescopic frame, taken in portion 5 of FIG. 4;

FIG. 6 is a side view of the present invention; and

FIG. 7 is a partial bottom view like in portion 7 of FIG. 4 and showing the brake in braking position

DETAILED DESCRIPTION OF THE PREFERRED EMBODIMENT

With reference to the annexed drawings the preferred embodiment of the present invention will be herein described for indicative purposes and by no means as of limitation.

Figure 1:
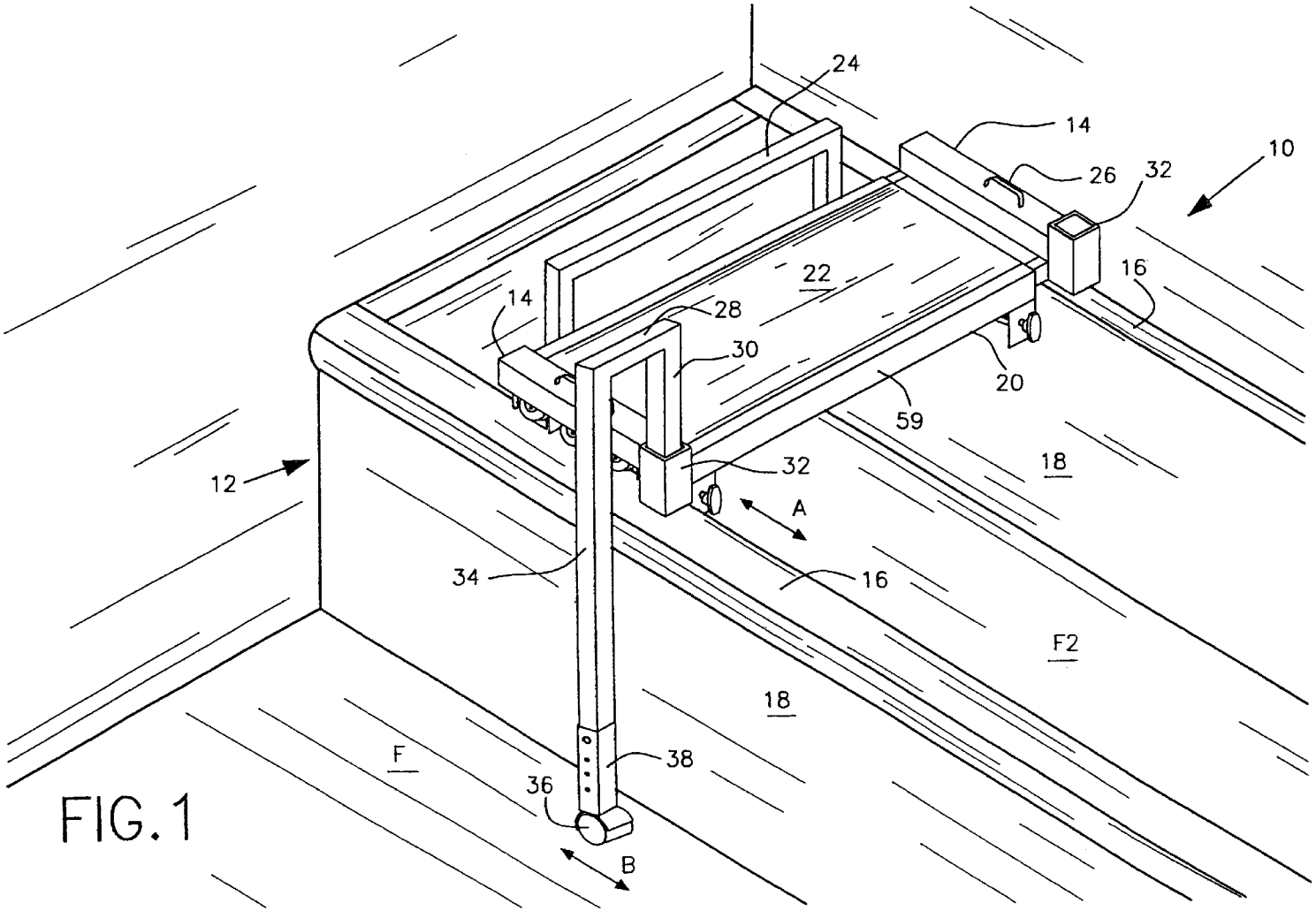
FIG. 1 is a perspective view of the present invention placed on a bathtub.

FIG. 1 shows the bathtub seat assembly 10 spanning the width of a bathtub 12 and positioned thereonto, having its end portions 14 placed over the top 16 of the bathtub side walls 18. The seat assembly 10 includes a seat frame 20 and seat panel 22, a backrest 24 removably secured on the seat frame 20, support handles 26 at each end portion 14 and a u-shaped cane member 28 providing the user with support when entering bathtub 10 to sit on seat panel 22 and when standing to exit bathtub 10. The shorter leg 30 of the cane member 28 is attached to the seat frame 20 by means of a connector 32 whereas the longer leg 34 of cane member 28 is outwardly spaced, relative to bathtub 10, engaging the bathroom floor F via a wheel 36 on its free end 38 and is adjustable to a variety of bathtub heights The seat assembly 10 has a connector 32 at each end portion 14 permitting the cane member 28 to be removably connected to either end portion 14 side of the seat assembly 10.

Seat panel 22 is preferably made out of a strong and thick plastic material whereas seat frame 20, backrest 24, handles 26 and cane member 28 are preferably made out of aluminum, copper, alloy or antirust plated metals to avoid rusting due to constant contact with water while maintaining enough strength to support users of various weights and sizes. These generally light weight materials make the bathtub seat assembly 10 portable and easy to transport when traveling.

Figure 2:
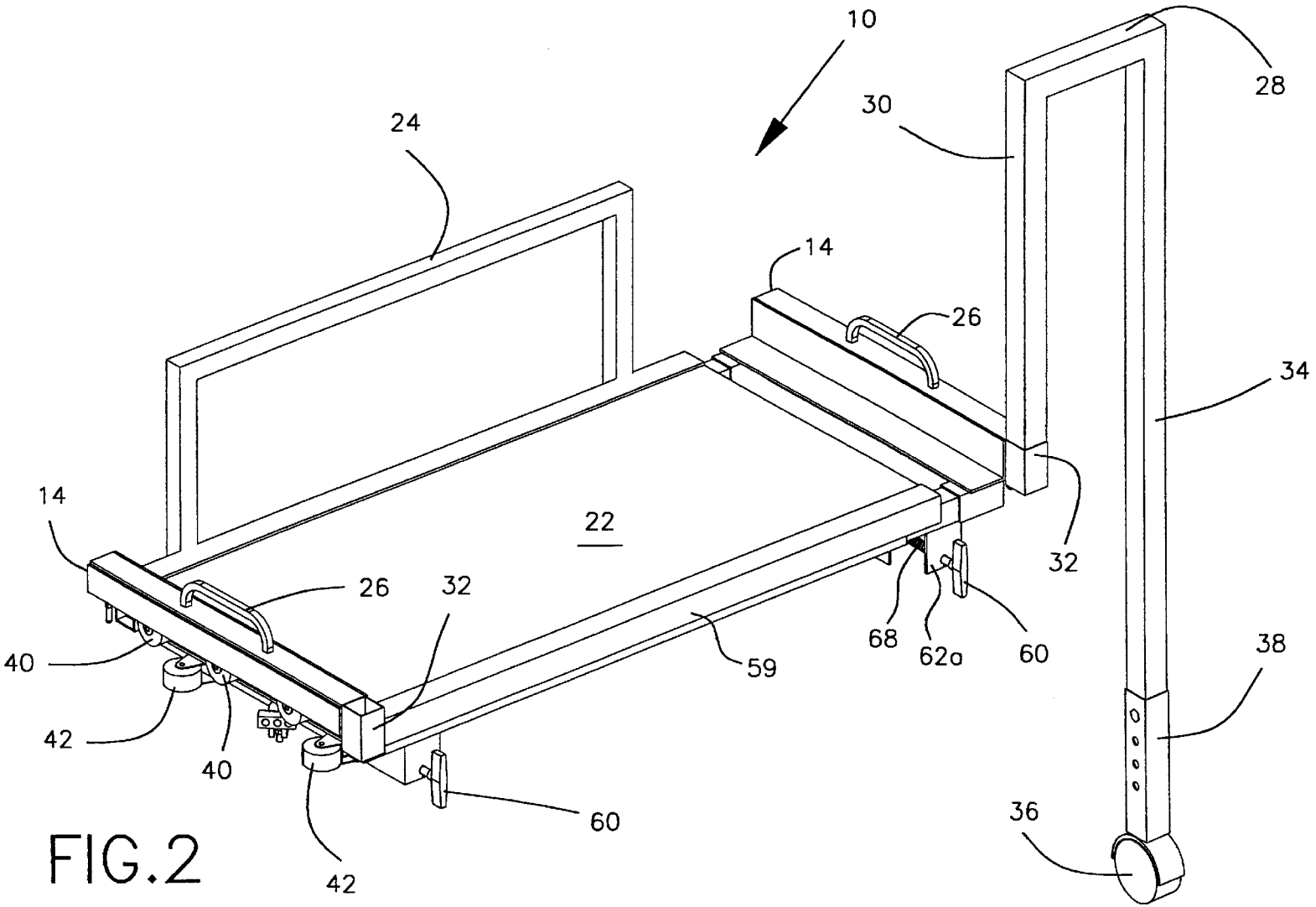
FIG. 2 is a view similar to FIG. 1 without the bathtub.
Figure 3:
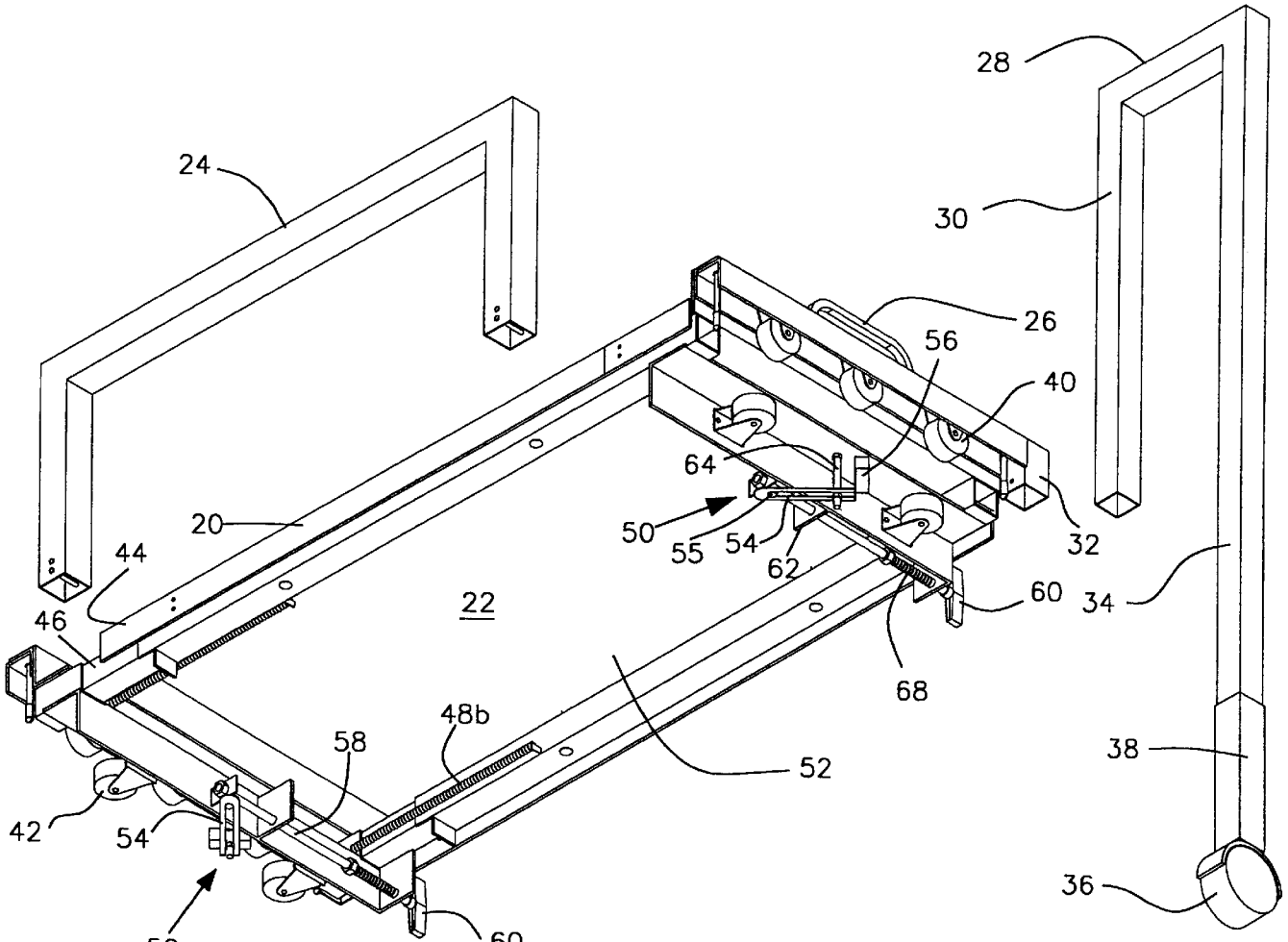
FIG. 3 is a perspective partially exploded bottom view of the present invention.

Referring to FIGS. 2 and 3 the end portions 14 of the seat assembly 10 are L-shaped and carry a first and second set of rollers 40, 42 respectively which rollingly engage the top 16 and the inside surface of the bathtub side walls 18 (see FIGS. 1 and 2) allowing the seat assembly 10 to roll longitudinally along the top 16 of side walls 18 as shown by double arrow A in FIG. 1 while being guided by rollers 42. Floor engaging wheel 36 allows the cane member 28 to roll along the bathroom floor F, as shown by double arrow B, with the seat assembly 10 as it rolls along the length of bathtub 12.

Seat frame 20 is formed of a first and second telescopic frame sections 44 and 46 respectively, with the first section 44 being longer than the second frame section 46 and having seat panel 22 secured on the top thereof. Each telescopic frame section 44, 46 carries a respective end portion 14 along with a respective first set of and second set of rollers 40, 42; together, sections 44, 46 provide for the seat frame 20 to be adjustable to a variety of bathtub widths. FIG. 5 shows compression springs 48 located within frame section 44 and abutting a cross pin 48*a* in section 44 at one end and the end portion of shorter telescopic frame section 46 at the other end to bias the two frame sections away from each other. Tension springs 48*b* are secured at both ends to the outside of frame sections 44 and 46 to retain the two sections 44, 46 against separation. The telescopic frame sections 44, 46 are biased to an Compression springs 48 cause extended state by means of tension springs 48 each fastened at one end to second set of rollers 42 of the telescopic frame sections 46, 48 to be pushed onto bathtub side walls 18. Hence, when the user will be seated on seat assembly 10 rollers 40 will also be pushed onto the top 16 of bathtub side walls 18 and since the rotation axes of first and second rollers 40, 42 are at substantially right angles as clearly shown in FIG. 6, the seat assembly 10 will securely and tightly rollingly grip the top 16 and the inside face of the bathtub side walls 18 providing sufficient stability to the seat of the present invention when in use.

With reference to FIGS. 3 and 4 the removable bathtub seat assembly 10 also includes a brake system 50 on its bottom face 52 near each end portion 14 which permits the user to stop the seat assembly 10 at any desired position along the bathtub 12. Each brake system 50 includes a lever arm 54, carried by each frame section 44, 46, pivotally connected to a pull rod manual actuator 58 via a pivot 55 at one end and having a brake pad 56 secured at the other end as more clearly shown in FIGS. 6 and 7. Lever arms 54 are movable between an inoperative position, when brake pad 56 is disengaged from bathtub (see FIG. 4) to an operative position, when lever arm 54 is straightened and brake pad 56 is engaging the bathtub side walls 18 (see FIG. 7) by means of the pull rod manual actuator 58 acting thereon. Pull rod manual actuators 58 have a handle 60 which protrudes outwardly of the front face 59 of the seat assembly 10 rendering handle 60 accessible, allowing the user to manually pull actuator rod 58 outwardly relative to the seat assembly 10, pull rod 58 being guided along guides 62, 62*a* carried by the respective telescopic frame sections 46. The brake system 50 also provides downwardly protruding pivot pins 64 carried by the respective telescopic frame sections 44, 46 and connected to the intermediate portion of lever 54 by being slidably inserted into a longitudinal slot 66 made in arm 54 for maintaining the lever arm 54 in position for pivotal and longitudinal movements between operative and inoperative positions.

Furthermore, and with particular reference to FIG. 7 the lever arm 54 and brake pad 56 together have a length which extends beyond rollers 42, hence when both lever arms 54 near each end portion 14 are in their operative position, at right angles to pull rod 58 and abutting guide plate 62, each brake pad 56 is engaged and pushed onto a respective bathtub side wall 18 with sufficient pressure exerted by compression springs 48 to completely and securely immobilize the seat assembly 10 at a given position along the length of bathtub 12. It must be noted that the lever arm 54 is biased to an inoperative non-straightened position by means of compression springs 68 carried by each pull rod 58 near handles 60 behind guide plate 62*a* and which bias pull rods 58 inwardly relative to seat assembly 10. When the seated user wishes to again mobilize the seat assembly 10 in order to move to another position, he may either push the pull rod handles 60 inwardly or push the seat assembly backwards using his legs to apply pressure on the bathtub floor F2 in order to pivot the lever arms 54 away from their operative position, this is further aided by springs 68, disengaging brake pads 56 from bathtub side walls 18. Preferably, the surfaces of rollers 40, 42 and brake pads 56 are either coated or rubberized to avoid marring or scratching the bathtub.

Therefore, seated users can move along the length of the bathtub as rollers 40, 42 securely roll on the top 16 and the inner side faces of bathtub side walls 18 and by applying pressure on the bathtub floor F2 with their legs as they hold onto seat support handles 26 to another desired position and pull on rod handles 60 to again immobilize the seat assembly 10. It must further be noted that in order to safely use the present invention the user must immobilize the seat assembly 10 as herein provided when getting into and getting out of bathtub 12. The present invention is easy to assemble and disassemble and is both strong and light to securely support the user and to be easily transportable.

Although the present slidable bathtub seat assembly has been described with a certain degree of particularity it is to be understood that the disclosure has been made by way of example only and that the present invention is not limited to the features of the embodiment described and illustrated herein, but includes all variations and modifications within the scope and spirit of the invention as hereinafter claimed.

I claim:

1. A bathtub seat assembly comprising a seating surface upon which the user sits and adapted to span a bathtub with its end portions extending over the top walls of the bathtub side walls, said seating surface carrying at each end portion thereof a first set and a second set of spaced rollers aligned transversely of said seat with their rotation axes at substantially right angles to directly and rollingly engage said top walls and the inside surface of said side walls respectively so that the seating surface may be moved by the seated user longitudinally of the bathtub, a braking system mounted on said seating surface and operable by the seated user to stop said seating surface at any desired position along the length of said bathtub and user supporting means adapted to rollingly engage the bathroom floor.

2. A bathtub seat assembly as defined in claim 1 wherein said seating surface includes a seat frame formed of two telescoping frame sections to fit bathtubs of various widths, one frame section being longer than the other frame section, said rollers mounted on the respective frame sections and a seat panel secured on top of said longer frame section.

3. A bathtub seat assembly as defined in claim 2 wherein said telescopic frame sections are spring biased to an extended state to bias said second sets of rollers against the inside surfaces of said side walls.

4. A bathtub seat assembly as defined in claim 3 wherein there are two braking systems respectively mounted on said two telescopic frame sections each system including a bathtub side wall engaging brake pad movable between operative and inoperative positions, spring biased to the inoperative position and a pull rod manual actuator connected to said brake pad to move said brake pad to said operative position.

5. A bathtub seat assembly as defined in claim 4 wherein each braking system further includes a mechanism to move said brake pad to the inoperative position upon said seated user moving said seat in one direction.

6. A bathtub seat assembly as defined in claim 5 wherein each braking system further includes guides carried by the related telescopic frame section and guiding said pull rod actuator for longitudinal movement and wherein said mechanism includes a lever arm to one end of which said brake pad is secured and the other end of which is pivoted to said pull rod, and a pivot carried by the related telescopic frame section and on which the intermediate portion of said lever arm is pivotally and longitudinally movable.

7. A bathtub seat assembly as defined in claim 6 further including a cane connector at each end portion of said seating surface, said user supporting means further including a u-shaped cane member having a shorter leg to be releasably connected to either one of said cane connectors and having a longer leg outwardly spaced from said end portion of said seat frame and adapted to be supported by the bathroom floor by a floor engaging wheel on the free end of said longer leg.

8. A bathtub seat assembly as defined in claim 7 further including a backrest removably secured to said seating surface.

9. A bathtub seat assembly as defined in claim 7 wherein said seat assembly is is made out of light weight materials thereby being portable and easy to transport when traveling.

10. A bathtub seat assembly as defined in claim 2 wherein there are two braking systems respectively mounted on said two telescopic frame sections, each braking system including a bathtub side wall engaging brake pad and a manual actuator connected to said brake pad.

11. A bathtub seat assembly as defined in claim 1 said user supporting means further including a u-shaped cane member having a shorter leg removably secured to and upstanding from one end portion of said seating surface frame and a longer leg outwardly spaced from said one end portion and adapted to be supported by the bathroom floor.

12. A bathtub seat assembly as defined in claim 11 further including a floor engaging wheel on the free end of said longer leg.

13. A bathtub seat assembly as defined in claim 12 further including a cane connector secured to each end portion of said seating surface releasably connect said shorter leg to either one of said end portions.

14. A bathtub seat assembly as defined in claim 1 further including a backrest removably secured to said seating surface.

15. A bathtub seat assembly as defined in claim 1 wherein said seat assembly is made out of light weight materials thereby being portably and easy to transport when traveling.

* * * * *